US007896285B2

(12) United States Patent
Wruck, Jr. et al.

(10) Patent No.: US 7,896,285 B2
(45) Date of Patent: Mar. 1, 2011

(54) SHEET PRODUCT DISPENSER

(75) Inventors: Walter O. Wruck, Jr., Neenah, WI (US); Brent J. Burns, Sterling Heights, MI (US); Daniel J. Geddes, Appleton, WI (US); John R. Moody, Winlock, WA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 53 days.

(21) Appl. No.: 12/038,216

(22) Filed: Feb. 27, 2008

(65) Prior Publication Data

US 2009/0212150 A1 Aug. 27, 2009

(51) Int. Cl.
*B65H 16/10* (2006.01)

(52) U.S. Cl. ..... 242/564.2

(58) Field of Classification Search ..... 242/564, 242/564.1, 564.2, 564.3, 564.4, 579, 580
See application file for complete search history.

(56) References Cited

U.S. PATENT DOCUMENTS

| | | | | | |
|---|---|---|---|---|---|
| 2,135,767 | A * | 11/1938 | Price et al. | ..... | 242/564.1 |
| 2,794,604 | A * | 6/1957 | Jacomaro | ..... | 242/560.3 |
| 3,012,834 | A * | 12/1961 | Mayall | ..... | 242/565 |
| 3,672,552 | A * | 6/1972 | Krueger et al. | ..... | 242/564.2 |
| 4,192,442 | A * | 3/1980 | Bastian et al. | ..... | 226/127 |
| 4,635,771 | A | 1/1987 | Shoji et al. | | |
| 4,699,304 | A * | 10/1987 | Voss et al. | ..... | 226/129 |
| 4,790,490 | A * | 12/1988 | Chakravorty | ..... | 242/564.1 |
| 5,655,722 | A | 8/1997 | Muckridge | | |
| 5,979,822 | A * | 11/1999 | Morand et al. | ..... | 242/564.2 |
| 6,206,322 | B1 * | 3/2001 | Elliott et al. | ..... | 242/564.2 |
| 6,224,010 | B1 * | 5/2001 | Morand | ..... | 242/564.4 |
| 6,237,871 | B1 * | 5/2001 | Morand et al. | ..... | 242/564.2 |
| 6,336,542 | B1 | 1/2002 | Mintonye, II | | |
| 7,380,748 | B2 * | 6/2008 | Goeking et al. | ..... | 242/564.2 |
| 2003/0164079 | A1 | 9/2003 | Budz et al. | | |
| 2006/0065094 | A1 | 3/2006 | Lewis et al. | | |
| 2006/0138274 | A1 * | 6/2006 | Goeking et al. | ..... | 242/564.4 |

* cited by examiner

*Primary Examiner*—William A Rivera
(74) *Attorney, Agent, or Firm*—Joel T. Charlton

(57) ABSTRACT

A dispenser for dispensing sheet product from a supply to a user is disclosed. The dispenser includes a feed device for dispensing a length of sheet product, an energy storage device in operable communication with the feed device, and a user interface in operable communication with the energy storage device. The user interface is biased in a first direction to a rest position by the energy storage device and is responsive to energy from the user to move in a second direction opposite the first direction and transfer energy to the energy storage device. The energy storage device is in operable connection with the feed device and applies the transferred energy to generate motion of the user interface in the first direction toward the rest position to actuate the feed device and dispense the sheet product.

16 Claims, 10 Drawing Sheets

SHEET PRODUCT DISPENSER

BACKGROUND OF THE INVENTION

The present invention relates generally to sheet product dispensers, and more particularly to sheet product dispensers adapted for dispensing sheet product from a roll.

Sheet product dispensers can provide a dispensing mechanism including a drive roll coupled to a reciprocating operating lever via one or more gear racks internal to the dispenser that engage a drive gear. Accordingly, sheet product is dispensed via the drive gear in response to user-provided energy via the operating lever.

While existing products are suitable for their intended purpose, application of excessive user force, or rate of force application, to the drive roll via the operating lever may result in a tear of the sheet product, thereby requiring dispenser service. Additionally, excessive force, or rate of force application, can result in reduced feed drive component reliability and additional dispenser service. Current approaches to reduce such service requirements include use of sheets having an appropriate strength to resist tears. However, sheet product having appropriate strength to resist tears may not provide desired properties such as absorbency, or facilitate perforation. Accordingly, there is a need in the art for a sheet product dispenser arrangement that overcomes these drawbacks.

BRIEF DESCRIPTION OF THE INVENTION

An embodiment of the invention includes a dispenser for dispensing sheet product from a supply to a user. The dispenser includes a feed device for dispensing a length of sheet product, an energy storage device in operable communication with the feed device, and a user interface in operable communication with the energy storage device. The user interface is biased in a first direction to a rest position by the energy storage device and is responsive to energy from the user to move in a second direction opposite the first direction and transfer energy to the energy storage device. The energy storage device is in operable connection with the feed device and applies the transferred energy to generate motion of the user interface in the first direction toward the rest position to actuate the feed device and dispense the sheet product.

Another embodiment of the invention includes a dispenser for dispensing sheet product from a roll to a user. The dispenser includes a feed roll for dispensing a length of the sheet product from the roll to the user, a spring in operable communication with the feed roll, and a push arm. The push arm is pivotally mounted about an axis disposed proximate one end of the push arm and is in operable communication with the spring and biased in a first direction to a rest position by the spring. The push arm is responsive to energy from the user to move in a second direction opposite the first direction and to transfer the energy to the spring. The spring is in operable connection with the feed roll and applies the transferred energy to generate motion of the push arm in the first direction toward the rest position to rotate the feed roll and dispense the sheet product.

A further embodiment includes a method of dispensing sheet product from a supply to a user. The method includes applying energy to an energy storage device via a user interface biased in a first direction to a rest position by the energy storage device. The applied energy moves the user interface in a second direction opposite the first direction. The method further includes transferring the applied energy from the energy storage device to a feed device via the user interface. The transferred energy moves the user interface in the first direction toward the rest position and dispenses the sheet product from the supply to the user.

These and other features of the present invention will be better appreciated by reference to the appended drawings and the description which follows.

BRIEF DESCRIPTION OF THE DRAWINGS

The invention is described in detail below with reference to the various figures wherein.

DETAILED DESCRIPTION OF THE INVENTION

Figure 1:
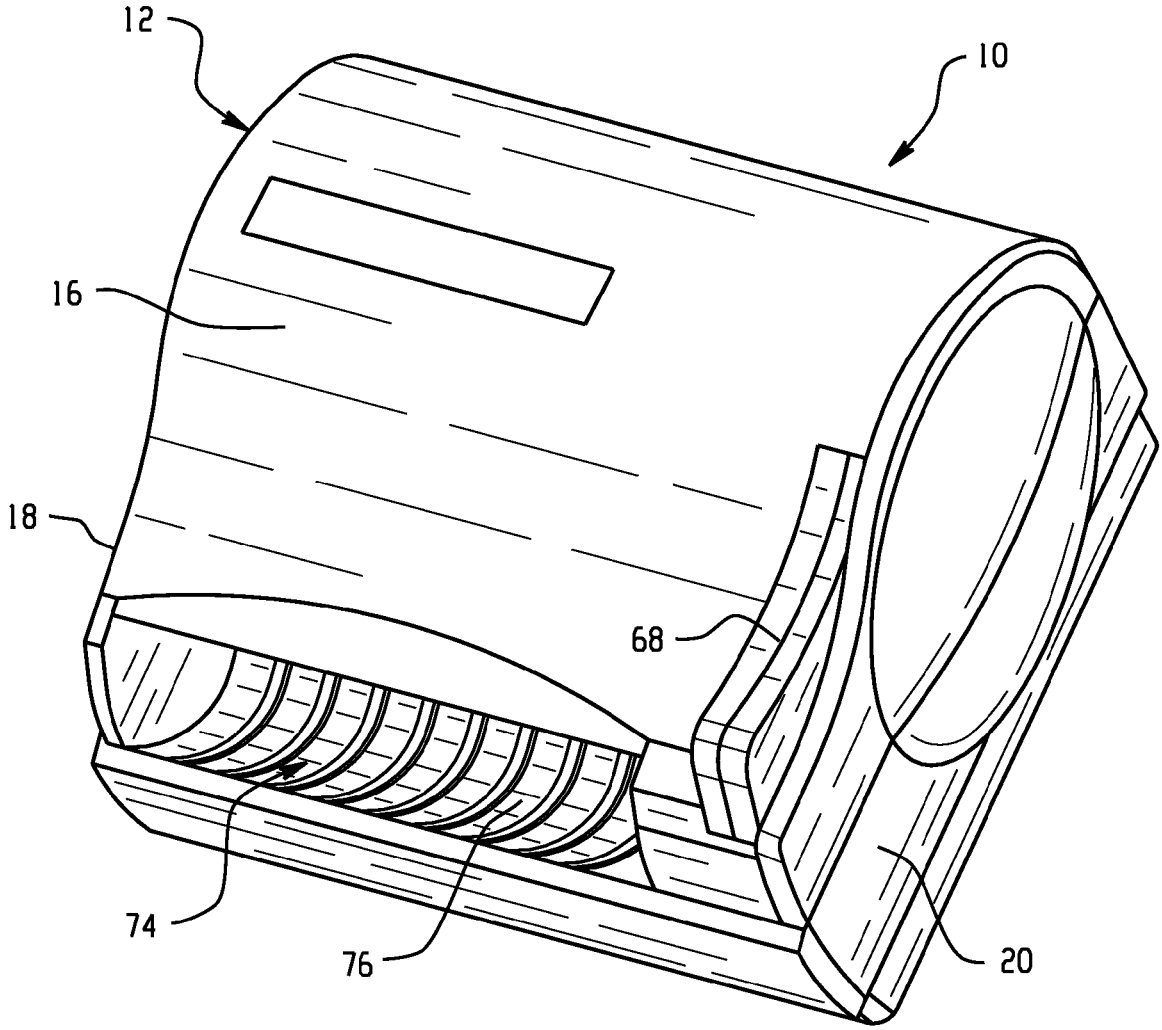
FIG. 1 is a perspective view of a sheet product dispenser in accordance with an embodiment of the invention.
Figure 2:
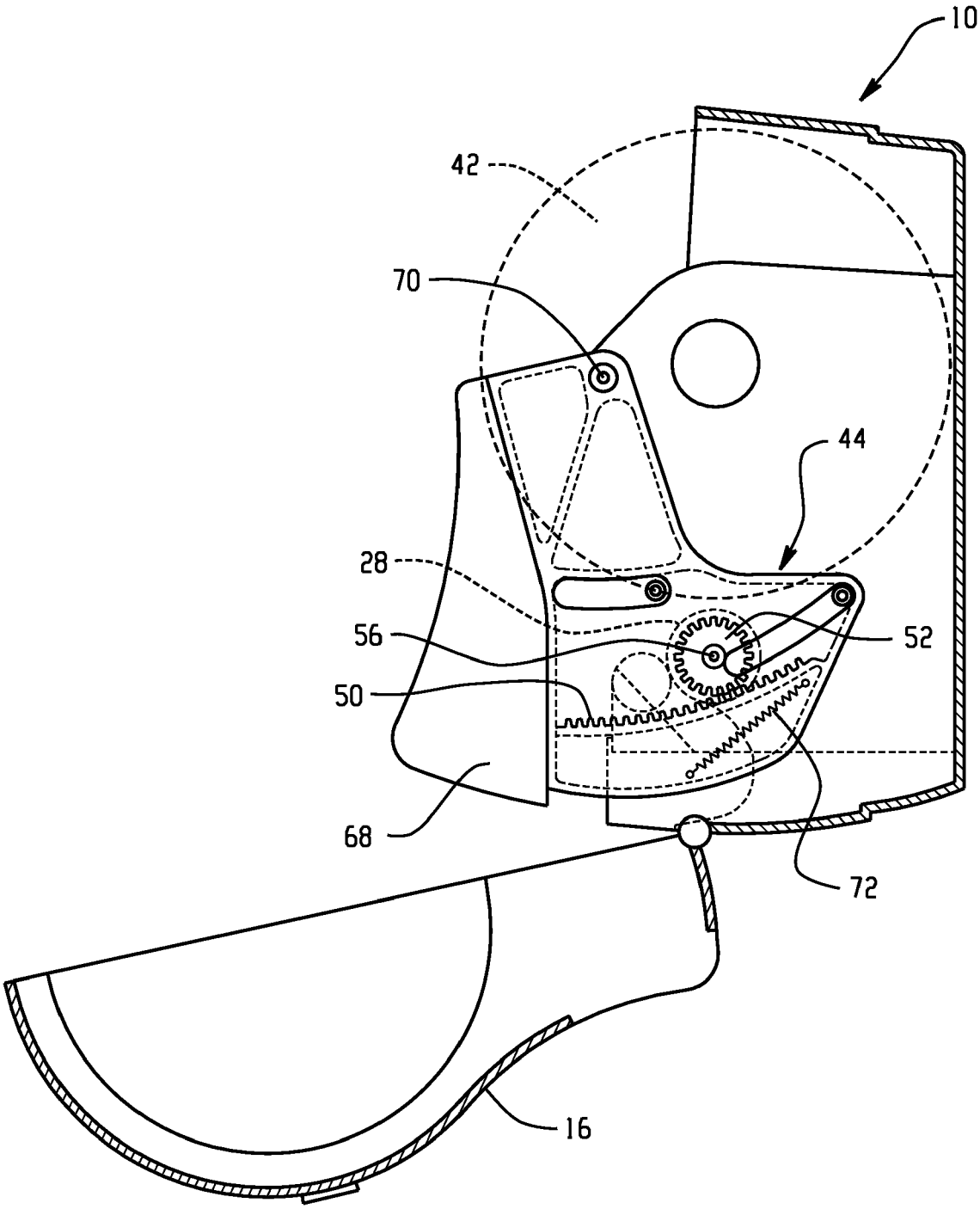
FIG. 2 is a schematic diagram showing various parts of a sheet product dispenser in accordance with an embodiment of the invention.
Figure 3:
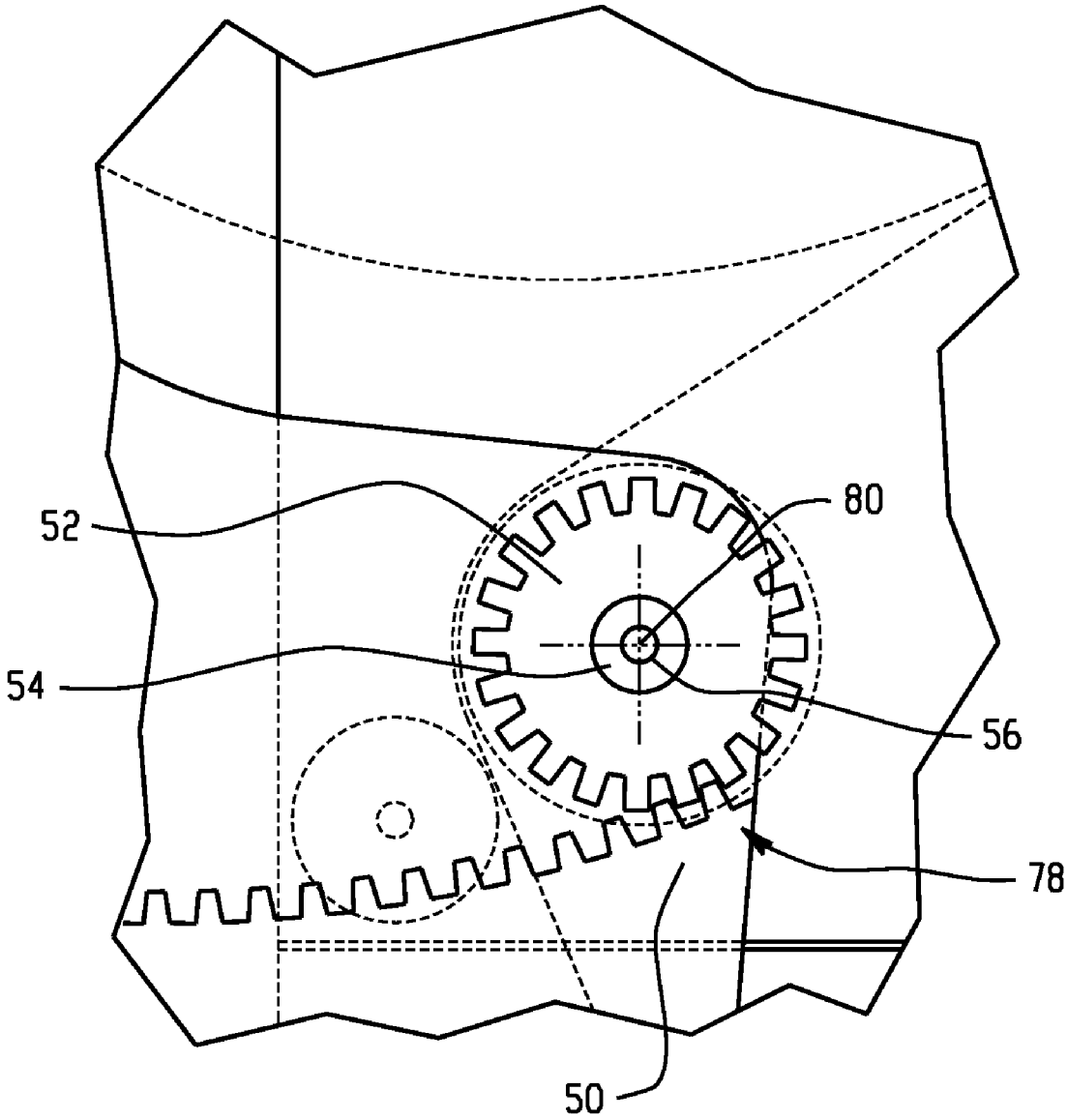
FIG. 3 is a schematic detail showing interaction of a clutch bearing and press bar assembly in accordance with an embodiment of the invention.

The present invention is described in detail below in connection with several embodiments for purposes of illustration only. Modifications to such embodiments, within the spirit and scope of the appended claims, will be readily apparent to those of skill in the art.

One embodiment of the invention provides an energy storage device to store energy supplied by a user, and release the stored energy to dispense sheet products. As used herein, the terms "sheet product" and "sheet products" are inclusive of natural and/or synthetic cloth or paper sheets. Further, sheet products can include both woven and non-woven articles. Examples of sheet products include, but are not limited to wipers, napkins, tissues, and towels. The energy storage device provides a controlled, consistent force to the sheet independent of an amount or rate of application of force by the user.

Referring generally to FIGS. 1 through 5, there is shown an embodiment of a sheet product dispenser 10 suitable for dispensing sheet product. Dispenser 10 includes a housing 12 defining an enclosure 14 with an enclosure front portion 16, enclosure sidewall portions 18, 20, an enclosure upper portion 22, and an enclosure lower portion 24. The dispenser 10 optionally includes an inner, modular chassis indicated at 25 to mount the various parts as is known in the art and may be made of any suitable material, such as plastic for example.

A dispensing nip 26 in the lower portion 24 of the housing 12 is defined in part by a drive roll 28 with first friction surface 30 defined by members 32 about the shaft of drive roll 28 and a second nip roll 34 having a second friction surface 36 whereby dispensing nip 26 is defined therebetween. At upper portion 22 of housing 12 there are provided hubs indicated at 38 and 40 for rotatably mounting a roll of sheet product in the upper portion 22 of enclosure 14 above dispensing nip 26. The drive roll 28 is mounted for rotation about a driveshaft mounted in a one-way clutch bearing as is further discussed below.

A roll 42, such as a supply or continuous web of sheet product (the terms roll, supply and web are used interchangeably throughout), is fed downwardly where the web is gripped between drive roll 28 and nip roll 34 by virtue of their friction surfaces. The friction surfaces 30, 36 may be continuous or may be formed with a plurality of disk-shaped members such as members 32. These may be made of any suitable material which provides friction, such as a soft rubber roll or a tracked plastic roll for example.

Figure 4:
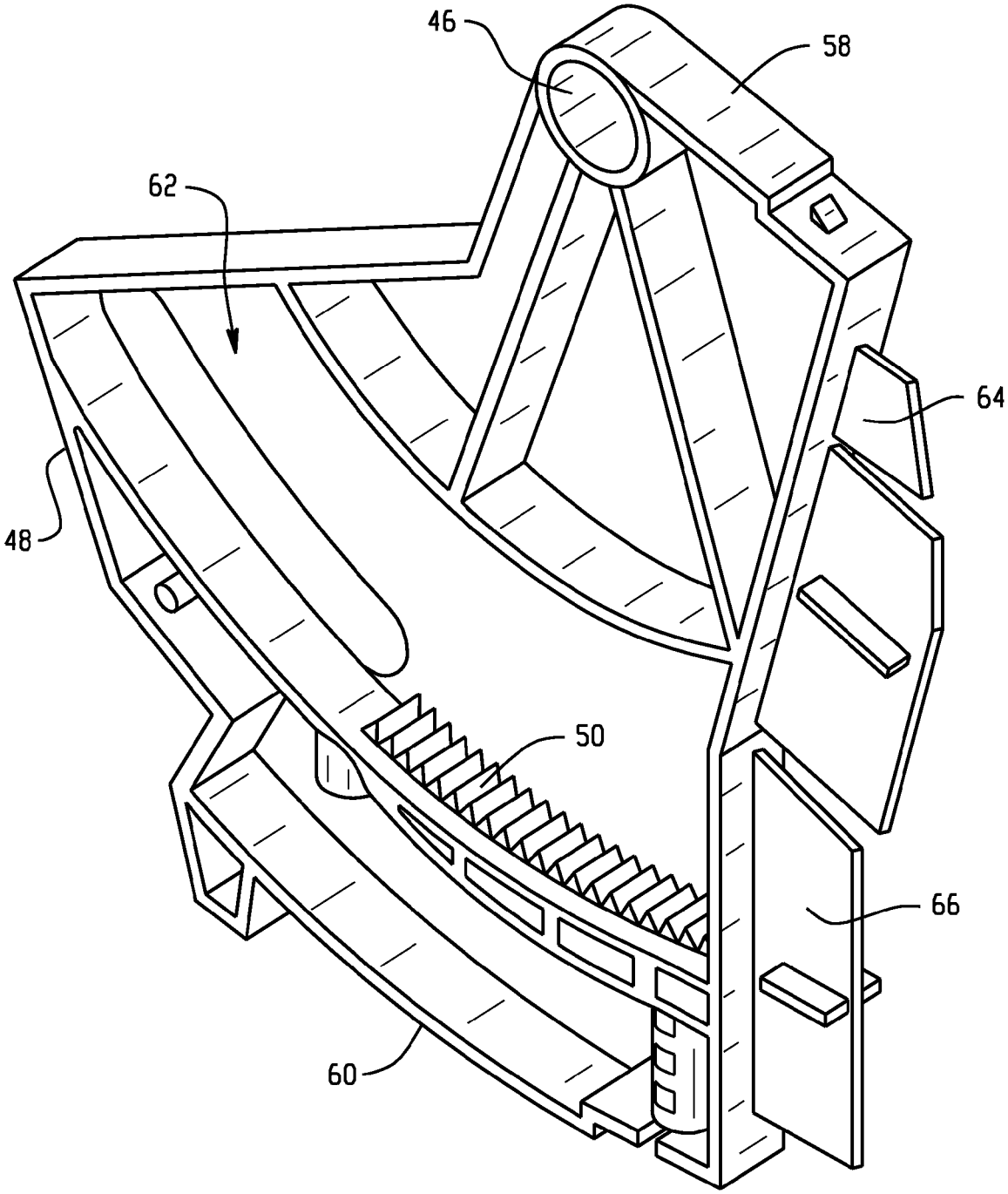
FIG. 4 is a schematic detail showing a unitary support member including a molded-in rack of a press bar assembly in accordance with an embodiment of the invention.
Figure 5:
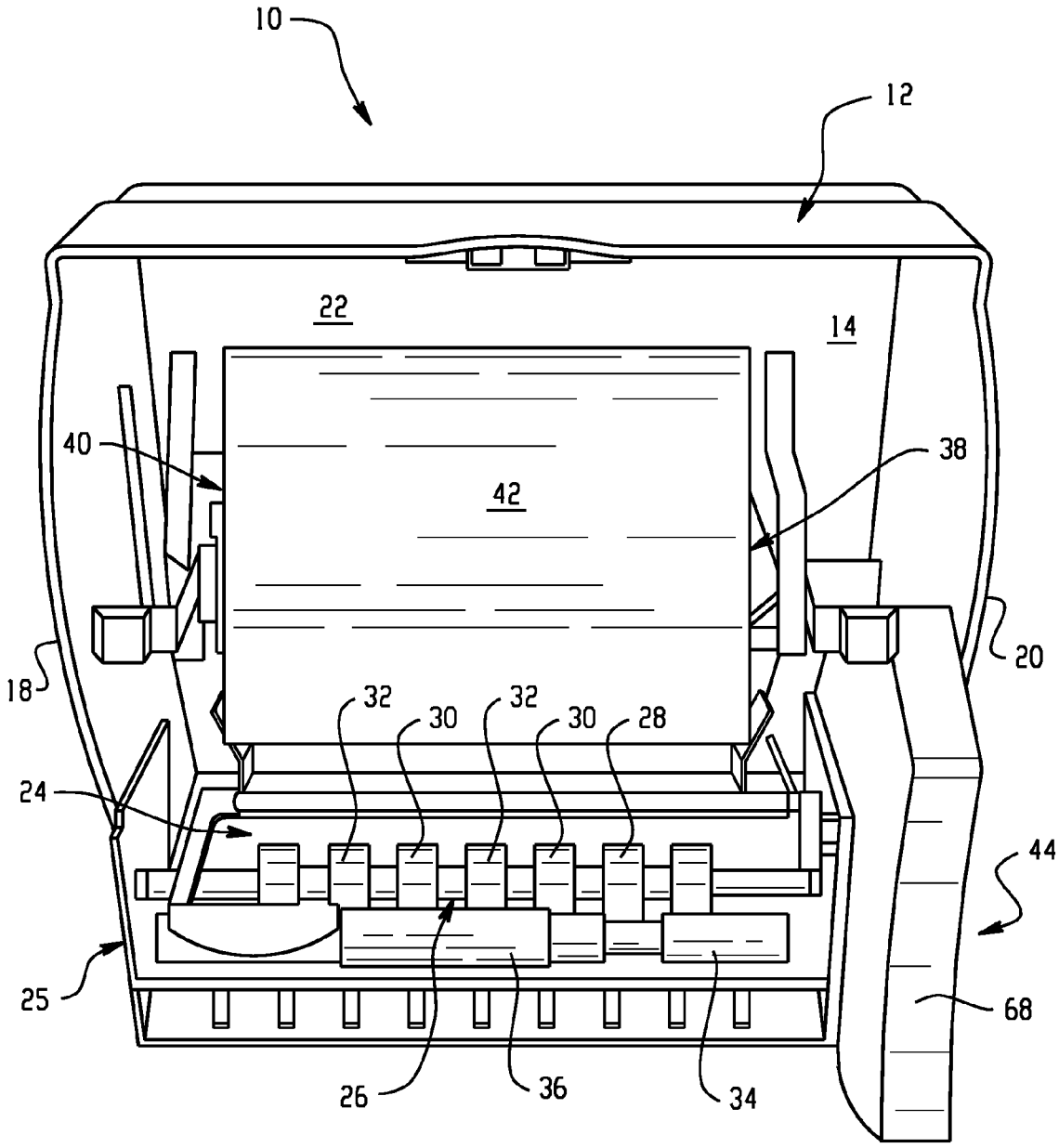
FIG. 5 is a schematic front interior view in elevation of the dispenser of FIG. 1.

One embodiment includes a vertically oriented press bar assembly 44 (also herein referred to as a "push arm") with an upper press bar assembly portion 46 mounted pivotably about its upper portion for inward and outward motion with respect to enclosure 14. Vertically oriented press bar assembly 44 includes at its lower portion 48 a molded-in rack 50 which engages pinion 52 coupled to drive roll 28 by way of a one-way clutch bearing 54 and a driveshaft 56. Driveshaft 56 is mounted in the clutch bearing 54 which has pinion 52 secured (such as by press-fit for example) thereabout such that the driveshaft 56 advances only when the press bar assembly 44 is being pushed inwardly from its rest position, as will be appreciated from FIGS. 1 through 4. The one-way clutch bearing 54 may be a needle clutch bearing. One-way clutch bearings and their application are further discussed in U.S. Pat. No. 4,635,771 to Shoji et al; U.S. Pat. No. 5,655,722 to Muckridge; as well as U.S. Pat. No. 6,336,542 to Mintonye, II, the disclosures of which are hereby incorporated by reference. As used herein the term "lower portion" of the press bar assembly 44 refers to the fact that rack 50 is located toward the lower extremity of the press bar assembly 44 as shown in the drawing. For example, the rack 50 is vertically more than half way toward the bottom of the press bar assembly 44 and alternatively more than about 65% of the distance from top 58 to bottom 60 of the press bar assembly 44 towards its lower portion 48 in order to maximize mechanical advantage. One embodiment includes a unitary support member 62 with the molded-in rack 50 as depicted in FIG. 4. Member 62 may include a plurality of tabs 64, 66, for example, to receive a press bar handle 68.

Handle 68 is coupled to the drive roll 28 via press bar assembly 44 and driveshaft 56 such that the drive roll 28 will advance web 42 through dispensing nip 26 upon pivotable motion of press bar assembly 44 about its pivot point indicated at 70.

There is further provided a spring 72 to bias the press bar assembly 44 towards the front of the dispenser 10 such that the press bar assembly 44 projects outwardly therefrom in a rest position as shown in FIG. 1. Stated alternatively, spring 72 biases the press bar assembly 44 to its rest position, whereas upon inward motion of the press bar assembly 44, rack 50 engages pinion 52 and drives drive roll 28 to advance the sheet as will be appreciated from FIGS. 1 through 4. Upon outward motion of press bar assembly 44, rack 50 still engages pinion 52, however, since bearing 54 is a one-way clutch bearing 54, pinion 52 is freewheeling and does not turn driveshaft 56.

A dispensing chute 74 located below dispensing nip 26 is provided with a lower arcuate shelf 76 configured to direct web 42 forwardly toward front portion 16 of dispenser 10.

In one embodiment rack 50 is an internal rack configured to engage the pinion 52 along a lower circumferential position 78 with respect to an axis of rotation 80 of the pinion 52, which is the same as the axis of driveshaft 56. Accordingly, rack 50 generally has a radius of curvature whose center is on the same side of the rack 50 as the gear teeth thereof. As noted above, clutch bearing 54 may be a one-way needle clutch bearing. An exemplary clutch bearing is Model No. HFZ 640 708E available from INA of Germany.

Figure 6:
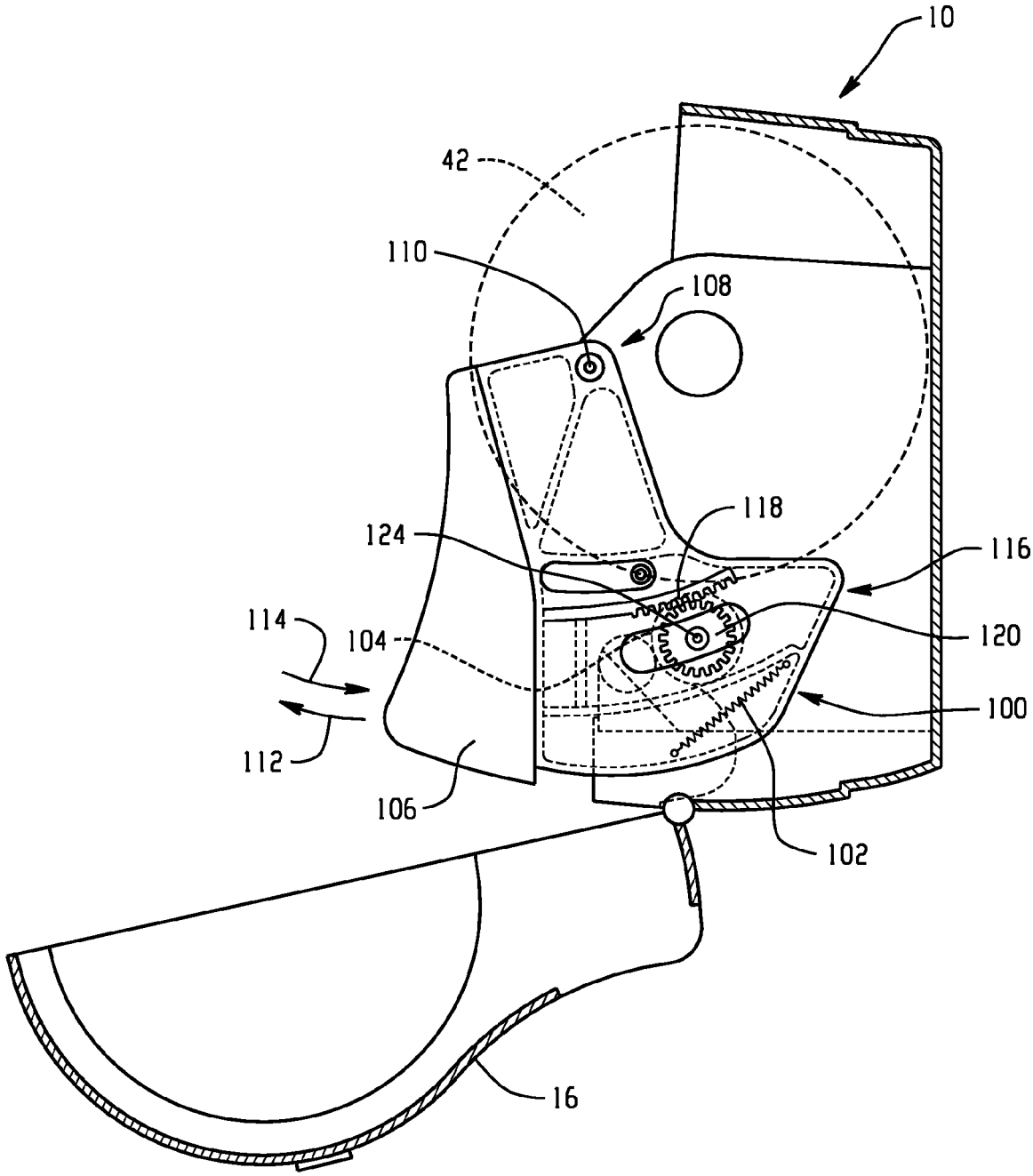
FIGS. 6 and 9 are schematic diagrams showing various parts of the dispenser in accordance with embodiments of the invention.
Figure 7:
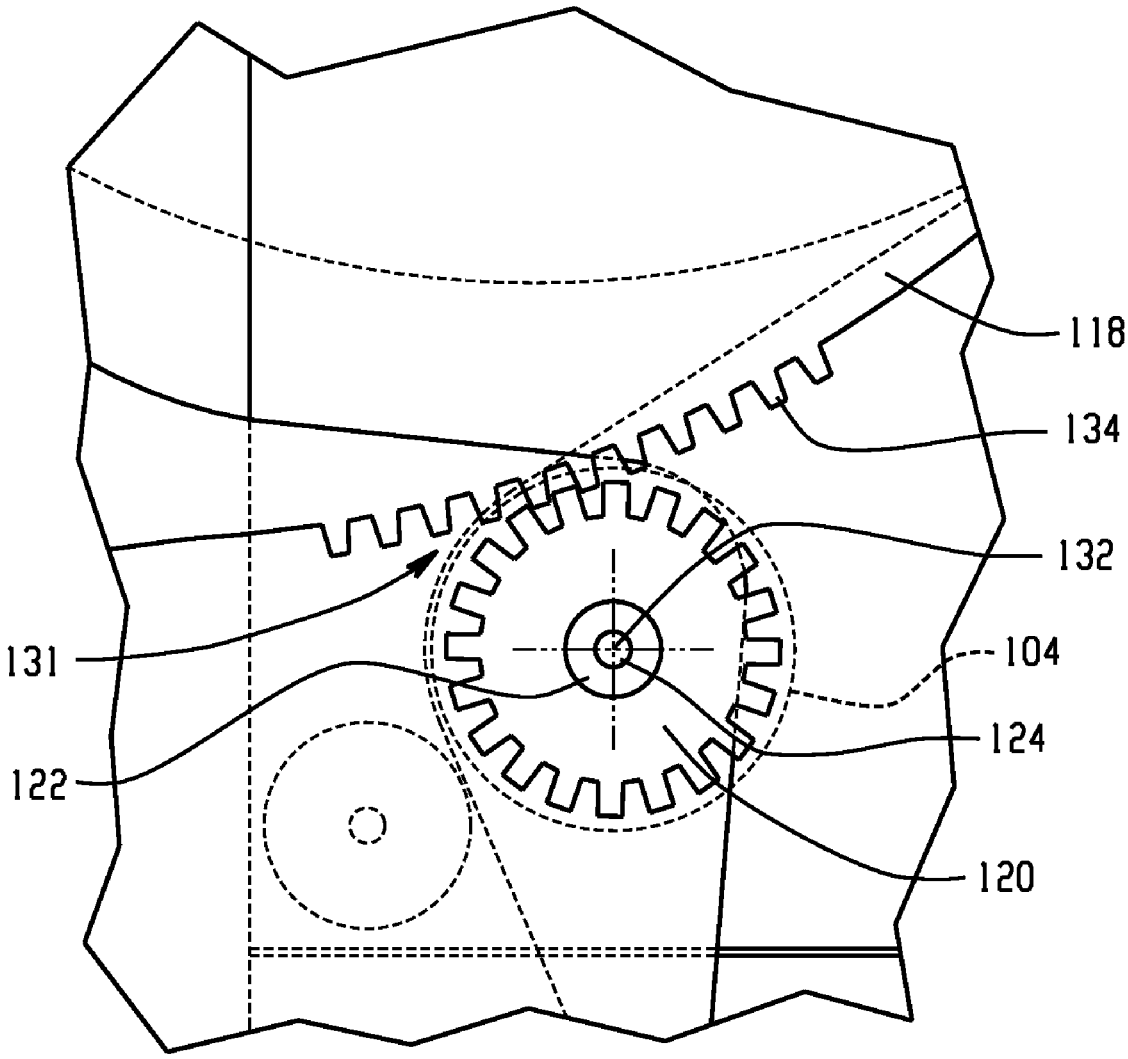
FIG. 7 is a schematic detail showing interaction of a clutch bearing and press bar assembly in accordance with an embodiment of the invention.
Figure 8:
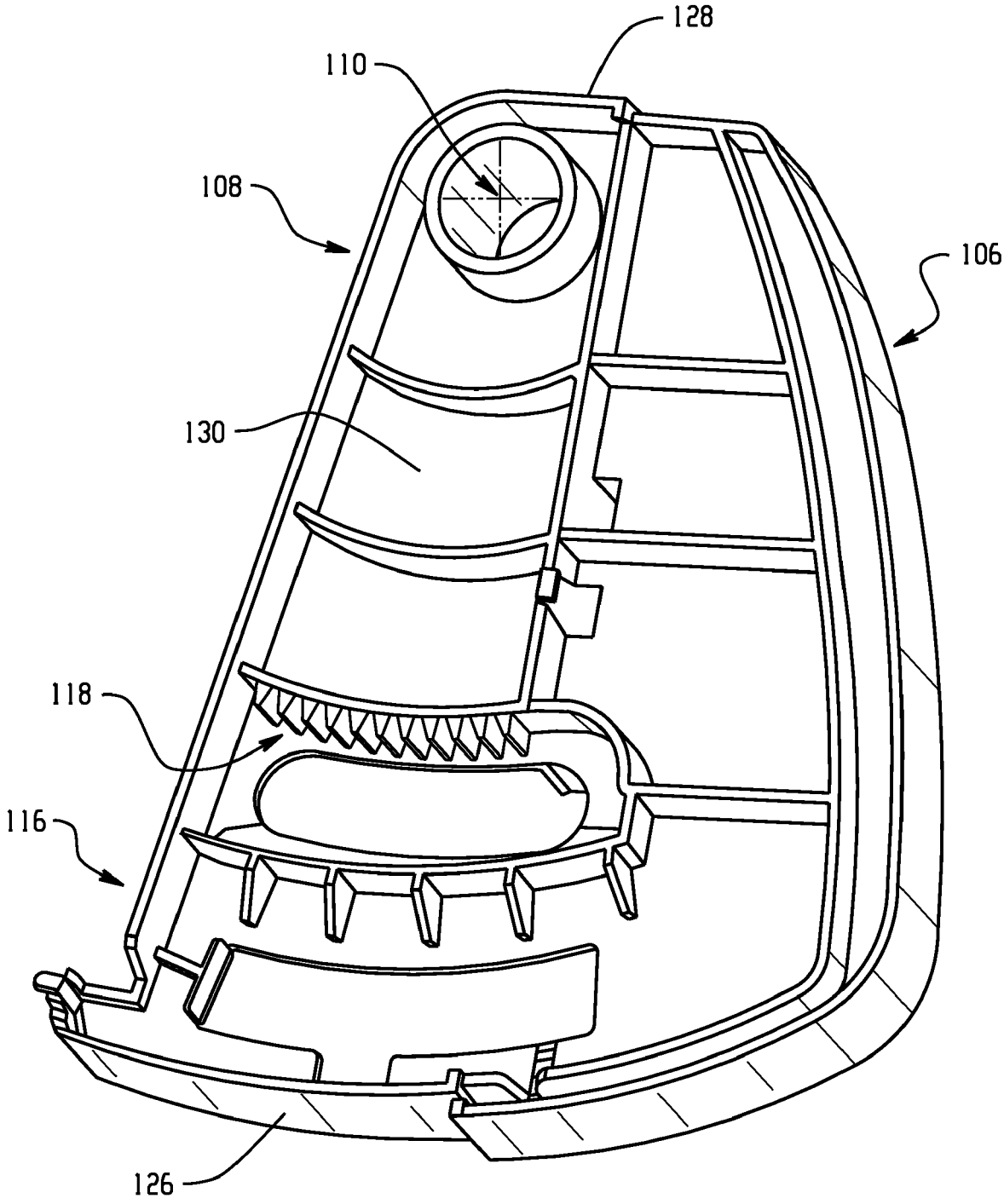
FIG. 8 is a schematic detail showing a unitary support member including a molded-in rack of the press bar assembly in accordance with an embodiment of the invention.

With reference now to FIGS. 6 through 8, an embodiment of the dispenser 10 employing an energy storage dispensing mechanism 100 is depicted. The energy storage dispensing mechanism 100 employs an energy storage device 102, such as a spring for example, to store and transfer energy from the user to dispense a length of sheet from the roll 42 in a controlled manner as will be described further below. It will be appreciated that while the energy storage dispensing mechanism 100 may be described with reference to one embodiment of the dispenser 10, the scope of the invention is not so limited, and the energy storage dispensing mechanism 100 may be incorporated within other embodiments of sheet product dispensers 10.

In one embodiment, the energy storage dispensing mechanism 100 includes a feed device 104, such as a feed roller, as part of the foregoing described dispensing nip 26 (FIG. 3), for example. The feed device 104 dispenses a length of sheet product from a supply, such as the roll 42, to the user. In one embodiment, a user interface 106 is mounted pivotably about an upper portion 108 at pivot 110 and is biased in a first direction 112, such as to a rest position as shown in FIG. 6, by the energy storage device 102. The user interface 106 is responsive to application of energy from the user to move in a second direction 114 opposite the first direction 112 and to transfer the energy from the user to the energy storage device 102. The energy storage device 102 is in operable connection with the user interface 106 and the feed device 104 to apply the transferred energy to generate motion of the user interface 106 in the first direction 112 toward the rest position and actuate the feed device 104, thereby dispensing sheet product from the roll 42.

In one embodiment, the user interface 106 is a vertically oriented push arm assembly and includes at its lower portion 116 a molded-in rack 118 which engages a pinion 120 coupled to the feed device 104 by way of a one-way clutch bearing 122 and a driveshaft 124. The one-way clutch bearing 122 is secured to pinion 120, such as via press-fit for example, and is in operable connection with the driveshaft 124. Upon motion of the user interface 106 in the second direction 114, such as in response to force applied by the user, the rack 118 engages pinion 120, however, since one-way clutch bearing 122 is a one-way clutch bearing 122, the pinion 120 is freewheeling and does not turn the driveshaft 124. Following such user force to displace the user interface 106 in the second direction 114, from the rest position, the energy storage device 102 biases the user interface 106 in the first direction 112 back toward the rest position. Such motion of the rack 118, responsive to the bias force provided by the energy storage device 102 in the first direction 112, engages the pinion 120 and is transferred via the one-way clutch bearing 122 to rotate the driveshaft 124 (and feed device 104) as the user interface 106 moves in the first direction 112. In one embodiment, the energy storage device 102 is a constant force spring to maintain application of a constant force throughout a range of motion of the user interface 106.

Therefore, the force applied to the feed device 104 and the sheet product is a function of the energy storage device 102 employed, and is independent of the force applied by the user to the user interface 106. Accordingly, the force, rate of force application, and thus, rate of dispensing speed of the sheet product is consistent, regardless of the force applied by the user to the user interface 106. Application of consistent force to the feed device 104 is contemplated to increase dispenser 10 reliability and allow use of sheet products that may have reduced strength such as softer, lighter basis weight, or perforated sheets, for example.

In one embodiment, the one-way clutch bearing 122 may be a needle clutch bearing as described above. As used herein the term "lower portion" of the user interface 106 refers to the fact that rack 118 is located toward the lower extremity of the user interface 106 as shown in FIGS. 6 and 8. For example, the rack 118 is vertically more than half way toward a bottom 126 of the user interface 106 and alternatively more than about 65% of the distance from top 128 to bottom 126 of the user interface 106 towards its lower portion 116 in order to maximize mechanical advantage. An exemplary embodiment of the user interface 106 includes a unitary support member 130 with the molded-in rack 118, such that material of the upper portion 108 is merged with material of the lower portion 116 as depicted in FIG. 8.

In one embodiment, rack 118 is an external rack 118 configured to engage the pinion 120 along an upper circumferential position 131 with respect to an axis of rotation 132 of the pinion 120, which is the same as the axis of driveshaft 124. For example, rack 118 generally has a radius of curvature whose center (the pivot 110) is on the opposite side of the rack 118 as gear teeth 134 thereof, such that the gear teeth 134 point away from the pivot 110.

Figure 9:
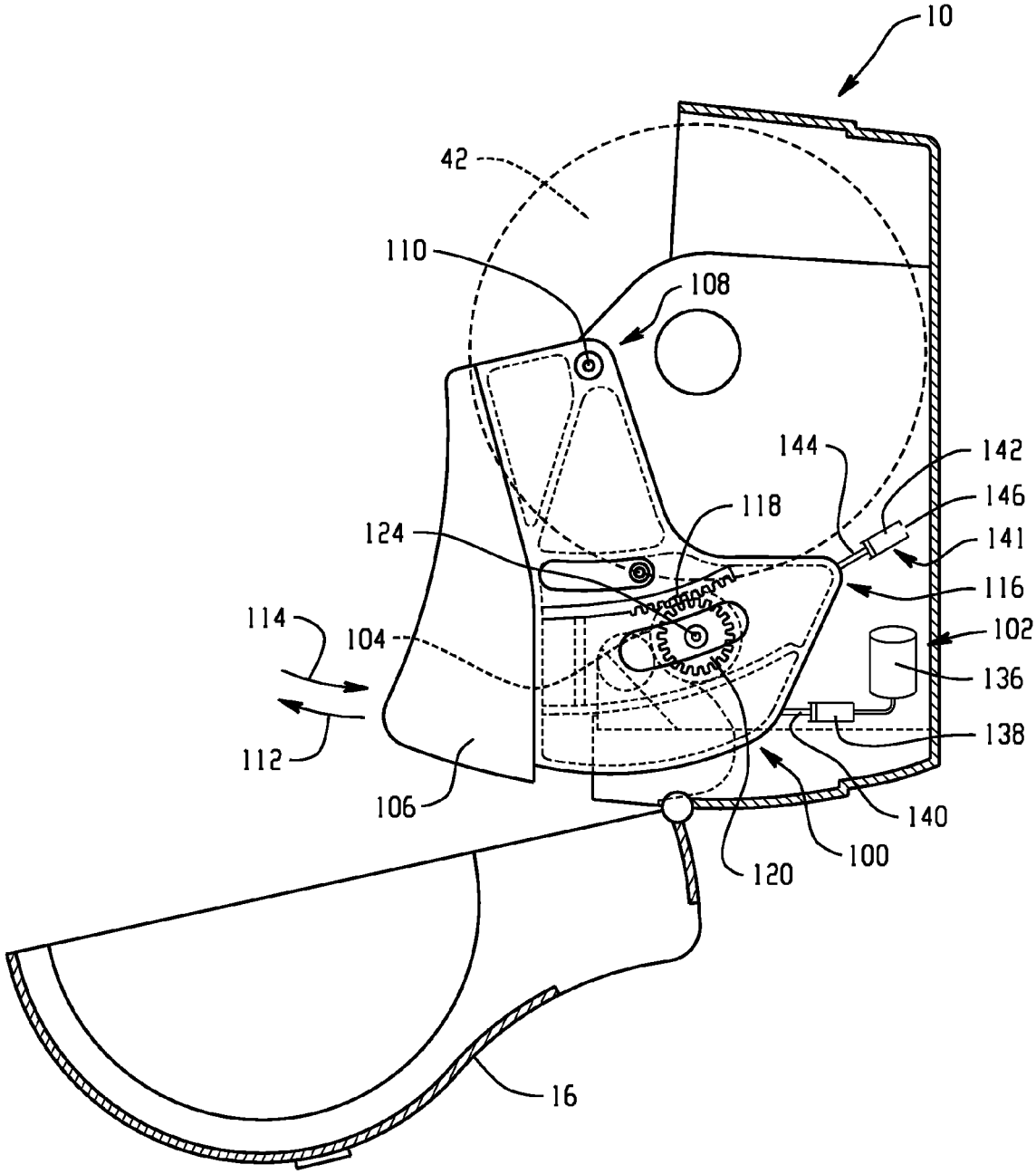

Referring now to FIG. 9, an alternate embodiment of the energy storage dispensing mechanism 100 is depicted. The energy storage device 102 includes a pneumatic storage vessel 136 to store and transfer energy applied by the user. In one embodiment, the pneumatic storage vessel 136 is a pressure containment vessel 136 and is in fluid communication with a cylinder 138 that is sealably disposed surrounding a piston 140 that is in operable communication with the user interface 106. In response to motion of the user interface 106 in the second direction 114, the piston 140 is displaced relative to the cylinder 138 and compresses a fluid, such as air for example, within the storage vessel 136 via the cylinder 138. The energy created by the compression of the fluid within the storage vessel 136 thereby biases the user interface 106 in the first direction 112 toward the rest position to dispense the sheet product as described above. In one embodiment, the energy storage dispensing mechanism 100 further includes a motion rate control 141 (e.g., damper), such as a damper or dashpot for example, to ensure that a velocity of the user interface 106 remains constant throughout its range of motion. For example, the motion rate control 141 may include a cylinder 142 that is sealably disposed surrounding a piston 144 that is in operable communication with the user interface 106. The cylinder 142 further includes an orifice 146 to control a rate of airflow into and out of the cylinder 142. In response to motion of the user interface 106 in either of the first direction 112 or the second direction 114 the rate of air flow through the orifice 146 regulates, or dampens a rate of motion of the user interface 106 in either the first direction 112 or the second direction 114.

Figure 10:
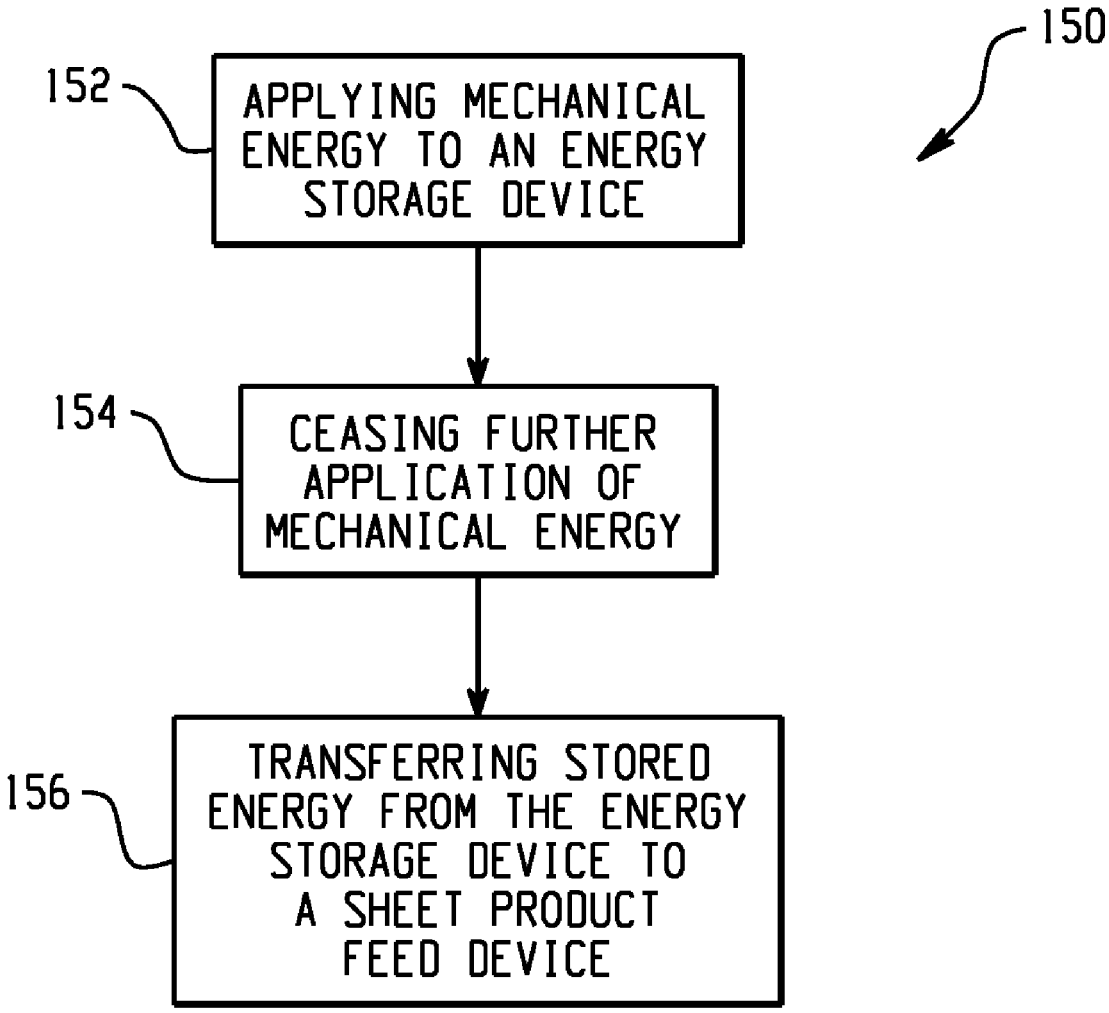
FIG. 10 is a flowchart of a method of dispensing sheet product in accordance with an embodiment of the invention.

FIG. 10 (with periodic reference to FIGS. 6 and 9) depicts a flowchart 150 of an exemplary method of dispensing sheet product from a supply to a user. The method begins at 152 with applying mechanical energy to the energy storage device 102 via the user interface 106 that is biased in the first direction 112 to a rest position by the energy storage device 102. The mechanical energy applied by the user to the user interface 106, moves the user interface 106 in the second direction 114, thereby storing the applied energy in the energy storage device 102.

At 154, the method proceeds with ceasing further application of mechanical energy to the user interface 106. Therefore, the user interface 106 is permitted to be biased in the first direction 112 under the influence of the stored energy in the energy storage device 102. In response to the user interface 106 moving in the first direction 112 toward the rest position, the method concludes at 156 with transferring the energy from the energy storage device 102 to the feed device 104 via the user interface 106, resulting in dispensing of sheet product from the supply 42 to the user.

While embodiments of the invention have been described with energy storage devices such as springs and pneumatic storage vessels, it will be appreciated that the scope of the invention is not so limited, and that other energy storage devices to store and transfer energy applied by the user are contemplated as within the scope of the invention, such as flywheels and generator/battery combinations, for example. Further, while an embodiment of the invention has been described and depicted having a vertically oriented user interface that pivots in an inwardly direction relative to the enclosure of dispenser, it will be appreciated that the scope of the invention is not so limited, and that the invention will also apply to other user interfaces that may incorporate other user interface motion and orientation, such as linear motion, which may be oriented horizontally, or may incorporate motions that are parallel to an exterior of the dispenser, for example.

As disclosed, some embodiments of the invention may include some of the following advantages: an ability to utilize at least one of softer, lighter basis weight, more absorbent, and pre-perforated sheet product by applying a consistent, appropriate drive force to the towels via the dispensing nip; an ability to increase feed drive component reliability by reducing any force shocks that may be user applied; an ability to meet Americans with Disabilities Act constant compliance since an initial force is set and will not change; and an ability to reduce overall cost of dispenser operation by reducing service requirements.

While the invention has been described with reference to exemplary embodiments, it will be understood that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A dispenser for dispensing sheet product from a supply to a user, the dispenser comprising:

a feed device for dispensing a length of sheet product from the supply to the user, the feed device comprising a feed roller;

a pinion in operable communication with the feed roller via a one-way clutch bearing;

an energy storage device in operable communication with the feed device to actuate the feed device; and a user interface in operable communication with the energy storage device and biased in a first direction to a rest position by the energy storage device, the user interface responsive to energy from the user to move in a second direction opposite the first direction and to transfer the energy to the energy storage device;

wherein the energy storage device is in operable connection with the feed device to apply the transferred energy to generate motion of the user interface in the first direction toward the rest position and actuate the feed device, wherein the user interface comprises a push arm pivotally mounted about an axis disposed proximate one end of the push arm, the push arm comprising a rack formed on the push arm and in operable communication with the pinion to rotate the pinion as the push arm pivots about the axis in the first direction, thereby dispensing the sheet product.

2. The dispenser of claim 1, wherein:

the energy storage device comprises a spring.

3. The dispenser of claim 2, wherein:

the energy storage device comprises a constant force spring.

4. The dispenser of claim 1, wherein:

the one-way clutch bearing engages and actuates the feed roller as the push arm pivots in the first direction toward the rest position.

5. The dispenser of claim 1, wherein:

the one-way clutch bearing rotates independent of the feed roll as the push arm pivots in the second direction from the rest position.

6. The dispenser of claim 1, wherein:

the rack is an external rack comprising gear teeth disposed on a side of the rack pointing away from the pivot.

7. The dispenser of claim 1, wherein:

the user interface is a vertically oriented push arm assembly having an upper portion and a lower portion, the push arm assembly being pivotally mounted about the upper portion; and the rack being disposed proximate the lower portion.

8. The dispenser of claim 7, wherein:

the push arm assembly comprises a unitary molded support member with material of the upper portion being merged with material of the lower portion.

9. The dispenser of claim 1, wherein:

the energy storage device comprises a pneumatic storage vessel.

10. The dispenser of claim 9, further comprising:

a piston in operable communication with the user interface; and a cylinder sealably disposed surrounding the piston;

wherein the pneumatic storage vessel is a pressure containment vessel.

11. The dispenser of claim 1, further comprising:

a damper in operable communication with the user interface.

12. The dispenser of claim 11, wherein the damper comprises:

a piston in operable communication with the user interface; and a cylinder comprising an orifice sealably surrounding the piston.

13. The dispenser of claim 1, wherein the feed device comprises:

a dispensing nip comprising a drive roll having a first friction surface in dispensing communication with a second friction surface.

14. The dispenser of claim 13, wherein the second friction surface is a nip roll.

15. The dispenser of claim 1, wherein:

the sheet product comprises a roll of paper towel material.

16. A dispenser for dispensing sheet product from a roll to a user, the dispenser comprising:

a feed roller for dispensing a length of the sheet product from the roll to the user;

a gear in operable communication with the feed roller via a one-way clutch bearing;

a spring in operable communication with the feed roller to rotate the feed roller; and a push arm pivotally mounted about an axis disposed proximate one end of the push arm, the push arm in operable communication with the spring and biased in a first direction to a rest position by the spring, the push arm responsive to energy from the user to move in a second direction opposite the first direction and to transfer the energy to the spring;

wherein the spring is in operable connection with the feed roller to apply the transferred energy to generate motion of the push arm in the first direction toward the rest position and rotate the feed roller, wherein the push arm comprises a rack formed on the push armed and in operable communication with the gear via the one-way clutch bearing to rotate the gear as the push arm pivots about the axis in the first direction under the influence of the spring, thereby dispensing the sheet product.

* * * * *